US008919871B2

(12) United States Patent
Huntsberger et al.

(10) Patent No.: US 8,919,871 B2
(45) Date of Patent: Dec. 30, 2014

(54) FOLDING INFANT SEAT WITH CANOPY

(75) Inventors: Kurt J. Huntsberger, Arcade, NY (US); Maarten Van Huystee, Lancaster, NY (US); Gregory S. Young, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 68 days.

(21) Appl. No.: 13/605,140

(22) Filed: Sep. 6, 2012

(65) Prior Publication Data

US 2013/0113240 A1 May 9, 2013

Related U.S. Application Data

(60) Provisional application No. 61/533,462, filed on Sep. 12, 2011.

(51) Int. Cl.

| | |
|---|---|
| ***A47D 1/02*** | (2006.01) |
| ***A47D 9/00*** | (2006.01) |
| ***A47D 15/00*** | (2006.01) |

(52) U.S. Cl.

CPC *A47D 1/02* (2013.01); *A47D 9/005* (2013.01); *A47D 15/00* (2013.01); *Y10S 297/11* (2013.01)

USPC ..... 297/45; 297/452.13; 297/DIG. 11; 297/184.13; 5/99.1

(58) Field of Classification Search

USPC ..... 297/16.1, 45, 184.15, 452.13, DIG. 11; 5/99.1, 102, 127

See application file for complete search history.

(56) References Cited

U.S. PATENT DOCUMENTS

| | | | | |
|---|---|---|---|---|
| 826,590 | A | | 7/1906 | Miller |
| 954,421 | A | | 4/1910 | Connery |
| 1,237,628 | A | | 8/1917 | Ford |
| 1,950,042 | A | | 3/1934 | Upper |
| 2,109,881 | A | | 3/1938 | Goldberg |
| 2,153,547 | A | * | 4/1939 | Charlop et al. ..... 135/121 |
| 2,467,890 | A | | 4/1949 | Harvey |
| 2,622,878 | A | | 12/1952 | Mooney |
| 2,661,482 | A | | 12/1953 | Zimov |
| 2,689,602 | A | * | 9/1954 | Morgan ..... 297/45 |
| 2,717,634 | A | * | 9/1955 | Lisi ..... 297/335 |
| 2,888,689 | A | | 6/1959 | Mourot |
| 2,916,744 | A | | 12/1959 | May |
| 3,180,685 | A | * | 4/1965 | Rogalski et al. ..... 297/440.24 |
| 3,839,754 | A | | 10/1974 | Hooper |
| 3,945,660 | A | | 3/1976 | Zalewski |

(Continued)

OTHER PUBLICATIONS

International Search Report for PCT/US2012/053881, dated Feb. 25, 2013.

*Primary Examiner* — Peter Brown

(74) *Attorney, Agent, or Firm* — Edell, Shapiro & Finnan, LLC

(57) ABSTRACT

A foldable infant seat includes a support frame including two generally U-shaped support members, each U-shaped support member pivotally connecting with the other at a central location of the U-shaped support member such that the support frame is foldable between a first configuration in which corresponding ends of the U-shaped support members are separated from each other and a second configuration in which the corresponding ends of the U-shaped support members are disposed in close proximity to each other. A flexible seat member is securable to the support frame. In one embodiment, a canopy is pivotally secured to the support frame. The canopy can include at least one pocket configured to store one or more items.

19 Claims, 8 Drawing Sheets

(56) References Cited

U.S. PATENT DOCUMENTS

| | | | | | |
|---|---|---|---|---|---|
| 4,030,748 | A | | 6/1977 | Brock | |
| 4,201,416 | A | | 5/1980 | Vanderminden | |
| 4,230,363 | A | | 10/1980 | Borichevsky | |
| 4,377,011 | A | | 3/1983 | Kinberger | |
| 4,538,309 | A | * | 9/1985 | Gunter | 5/99.1 |
| 4,583,778 | A | * | 4/1986 | Liebhold | 297/56 |
| 4,640,519 | A | | 2/1987 | Bigo | |
| 4,643,479 | A | | 2/1987 | Servi | |
| 4,688,280 | A | * | 8/1987 | Kohus et al. | 5/99.1 |
| 4,703,525 | A | | 11/1987 | Shamie | |
| D294,901 | S | | 3/1988 | Partin | |
| 5,058,949 | A | | 10/1991 | Von Hoffman | |
| 5,203,363 | A | | 4/1993 | Kidwell et al. | |
| 5,205,308 | A | | 4/1993 | Kendall et al. | |
| 5,269,587 | A | | 12/1993 | Cunningham et al. | |
| 5,441,067 | A | * | 8/1995 | James et al. | 297/184.15 |
| 5,449,014 | A | | 9/1995 | Yan-ho | |
| 5,470,039 | A | | 11/1995 | Hilger | |
| 5,496,094 | A | | 3/1996 | Schwartzkopf et al. | |
| 5,503,458 | A | | 4/1996 | Petrie | |
| 5,560,383 | A | | 10/1996 | Fuller | |
| 5,709,428 | A | | 1/1998 | Hugghins | |
| 5,819,341 | A | | 10/1998 | Simantob et al. | |
| 5,951,103 | A | | 9/1999 | Barnhill | |
| 5,987,665 | A | | 11/1999 | Simantob et al. | |
| 6,371,553 | B1 | | 4/2002 | Tang | |
| 6,439,659 | B1 | | 8/2002 | Neubauer, Jr. | |
| 6,687,928 | B1 | | 2/2004 | Wilson | |
| 6,739,649 | B2 | | 5/2004 | Kelly et al. | |
| 6,764,133 | B2 | | 7/2004 | Osato | |
| 7,150,162 | B1 | | 12/2006 | Brunner | |
| 7,204,549 | B1 | * | 4/2007 | Zeng | 297/45 |
| 7,374,237 | B2 | | 5/2008 | Park et al. | |
| 7,861,735 | B2 | | 1/2011 | Stepaniuk et al. | |
| 7,909,395 | B2 | | 3/2011 | Reeb et al. | |
| 2002/0002741 | A1 | | 1/2002 | Tomas et al. | |
| 2009/0101189 | A1 | | 4/2009 | Tatham | |
| 2009/0250978 | A1 | | 10/2009 | Reynolds | |
| 2010/0096890 | A1 | | 4/2010 | Whitlock | |
| 2010/0109391 | A1 | | 5/2010 | Berry | |
| 2011/0148155 | A1 | | 6/2011 | Chapman et al. | |

* cited by examiner

FOLDING INFANT SEAT WITH CANOPY

CROSS-REFERENCE TO RELATED APPLICATIONS

This application claims the benefit of and priority under 35 U.S.C. 119(e) to U.S. Provisional Application No. 61/533,462, entitled "Folding Infant Seat With Canopy", filed Sep. 12, 2011, the disclosure of which is incorporated herein by reference in its entirety.

FIELD OF THE INVENTION

The present invention relates to an infant seat to support an infant and including a canopy, where the seat is collapsible from a first configuration during use to a second, folded configuration during non-use.

BACKGROUND

Child support structures such as bouncers support young children during play and other seated activities. In particular, certain seats incorporate play toys into the seat as well as bouncing or vibrating mechanisms or music to stimulate the child while seated within the seat. Often, bouncers and other infant seats must be configured for transport or storage.

It is desirable for an infant seat to be safe and easily collapsible for transport or storage, including features for securing of the accessories that may be associated with the infant seat.

SUMMARY

A foldable infant seat comprises a support frame comprising two generally U-shaped support members, each U-shaped support member pivotally connecting with the other at a central location of the U-shaped support member such that the support frame is foldable between a first configuration in which corresponding ends of the U-shaped support members are separated from each other and a second configuration in which the corresponding ends of the U-shaped support members are disposed in close proximity to each other, a flexible seat member securable to the support frame, and a canopy pivotally secured to the support frame, the canopy including at least one pocket configured to store one or more items.

In another embodiment, a foldable infant seat comprises a support frame comprising two generally U-shaped support members, each U-shaped support member including a base portion that supports the U-shaped support member on a support surface, a front arm and a rear arm extending from opposing ends of the base portion in an upward direction away from the support surface when the base portion is supported on the support surface, where each base portion is pivotally connected to the other base portion such that the support frame is foldable between a first configuration in which the front arms of each of the U-shaped support members are separated from each other and the rear arms of each of the U-shaped support members are separated from each other and a second configuration in which the front arms of each of the U-shaped support members are in close proximity to each other and the rear arms of each of the U-shaped support members are in close proximity to each other. The foldable infant seat further comprises a pair of support bars, each support bar connecting with the front arm of one of the U-shaped support members and the rear arm of the other of the U-shaped support members, and a flexible seat member securable to the support bars.

A method of using a foldable infant seat is further provided, where the infant seat comprises a support frame including two generally U-shaped support members, each U-shaped support member including a base portion, a front arm and a rear arm extending from opposing ends of the base portion, wherein each base portion is pivotally connected to the other base portion, a pair of support bars, a pair of support bars, each support bar connecting with the front arm of one of the U-shaped support members and the rear arm of the other of the U-shaped support members, and a flexible seat member securable to the support bars. The method comprises unfolding the support frame from a storage configuration in which the front arms of each of the U-shaped support members are in close proximity to each other and the rear arms of each of the U-shaped support members are in close proximity to each other to an open configuration in which the front arms of each of the U-shaped support members are separated from each other and the rear arms of each of the U-shaped support members are separated from each other.

DETAILED DESCRIPTION

The present invention is directed toward a foldable infant seat. The infant seat includes a support frame comprising two generally U-shaped support members, each U-shaped support member connecting with the other at a hub disposed at a central location of each U-shaped support member. The infant seat further includes a flexible, soft goods seating portion that connects with the U-shaped support members to provide a seat support for an infant and also a canopy that connects at upper ends of U-shaped support members to provide a shaded canopy for an infant that is supported on the seat support during use of the infant seat. The support frame is configured to releasably lock the U-shaped support members in a first, open or use configuration in which the U-shaped support members are spread outward and extend transversely with respect to each other at their central locations and the corresponding ends of the U-shaped support members are spaced apart from each other. In addition, the support frame is further configured to releasably lock the U-shaped support members in a second, storage, configuration in which the U-shaped support members are rotated at the hub and are collapsed toward each other such that their corresponding ends are located closer to each other in relation to the first configuration. In the second, storage, configuration, the flexible seat portion is foldable between the two U-shaped support members and the canopy is pivotable with respect to the U-shaped support members into a storage position. In an example embodiment, the foldable infant seat includes a canopy as described herein.

Figure 1:
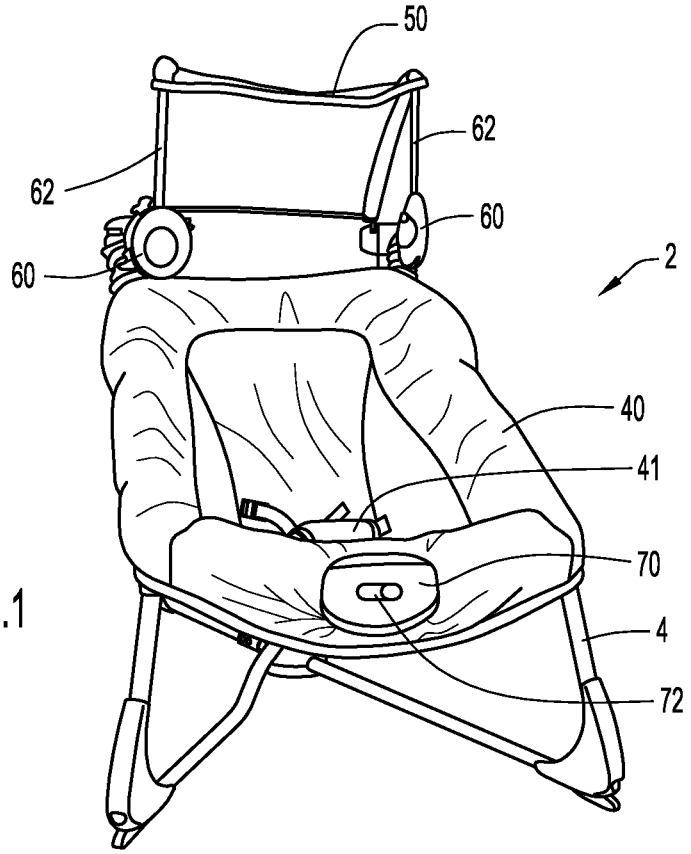
FIG. 1 illustrates a front view of a folding infant seat with canopy in accordance with an example embodiment of the present invention.
Figure 2:
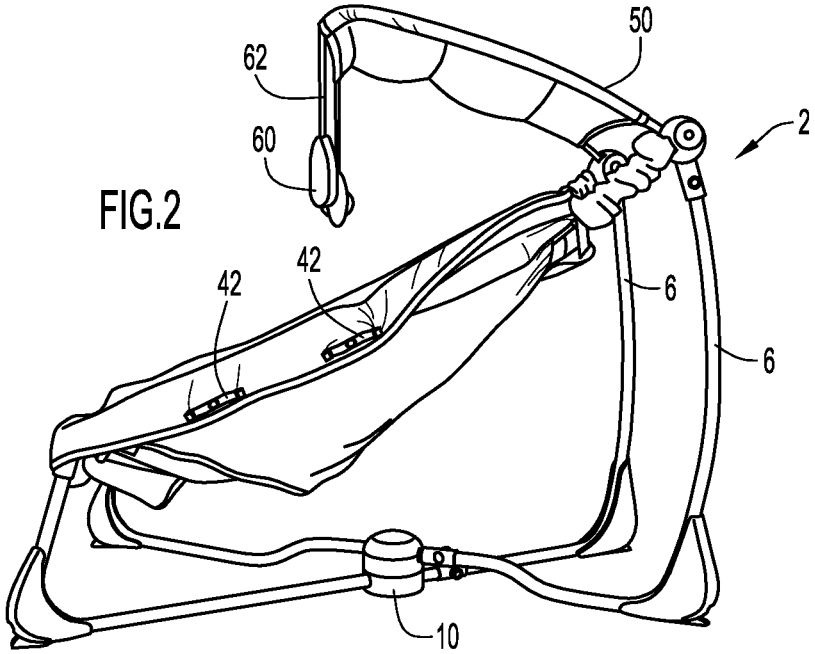
FIG. 2 illustrates a side view of the folding infant seat of FIG. 1.

FIGS. 1 and 2 illustrate an infant seat 2 including a support frame 4, a flexible seat portion 40 and a canopy 50 pivotally coupled to the support frame 4. In addition, the infant seat 2 can include an electronic unit 70 that provides vibratory motions (e.g., for stimulation) and/or sounds that can be selectively controlled by a user during operation of the infant seat 2.

As described herein, the support frame 4 is foldable between an extended position for use of the infant seat 2 and a collapsible position for storage. In addition, as described herein, the canopy 50 is pivotally movable to different positions with respect to the support frame 4 and includes one or more storage pockets to store items (e.g., toys and/or other accessories). The components of the support frame 4, as well as the supporting frame components for the canopy 50, can be constructed of any suitably rigid materials (e.g., metals and/or molded plastic materials). The flexible seat portion 40 and flexible portions of the canopy 50 can be constructed of any suitably flexible soft goods materials (e.g., cloth or fabric materials).

The features of the support frame 4 are shown in FIGS. 3-7. For ease of reference, and to provide a clear understanding of the foldable/collapsible features of the infant seat 2, FIGS. 3-7 depict only the support frame 4 without the seat portion 40 or canopy 50. The support frame 4 includes two generally U-shaped support members 6 that connect with each other at a central portion of each U-shaped support member 6. In particular, each U-shaped support member 6 includes a base portion 7 that supports the frame 4 on a support surface, a rear arm 8 disposed at a rear end of the seat 2 and a front arm 9 disposed at a front end of the seat 2, where both arms 8, 9 extend upwardly and away from the base portion 7 so as to define the U-shaped configuration for the member 6. Each of the base portion 7 and the front and rear arms 8, 9 can have any suitable cross-sectional geometry (e.g., circular, square, rectangular, etc.). The rear arms 8 for both U-shaped support members 6 have a greater longitudinal or lengthwise dimension and thus extend to a greater elevation from the base portions 7 (and support surface upon which the seat 2 is placed) in relation to the front arms 9. Each U-shaped support member 6 can also include support feet 11 that connect with the member 6 at the juncture between the rear arm 8 and base portion 7 and the front arm 9 and the base portion 7. The support feet 11 can be designed to enhance the stability of the support frame 4 as well as prevent slipping or sliding of the frame 4 on certain support surfaces.

Figure 3:
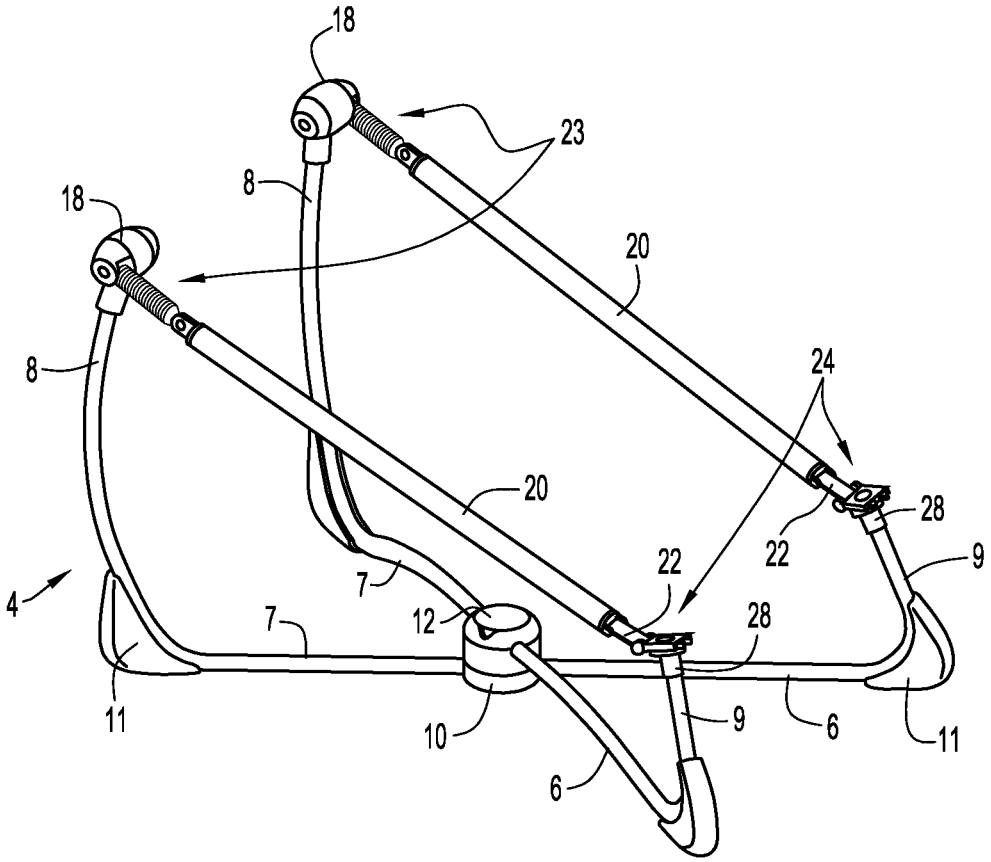
FIG. 3 illustrates an isolated, perspective view of the frame of the infant seat of FIG. 1 in an expanded configuration.
Figure 4:
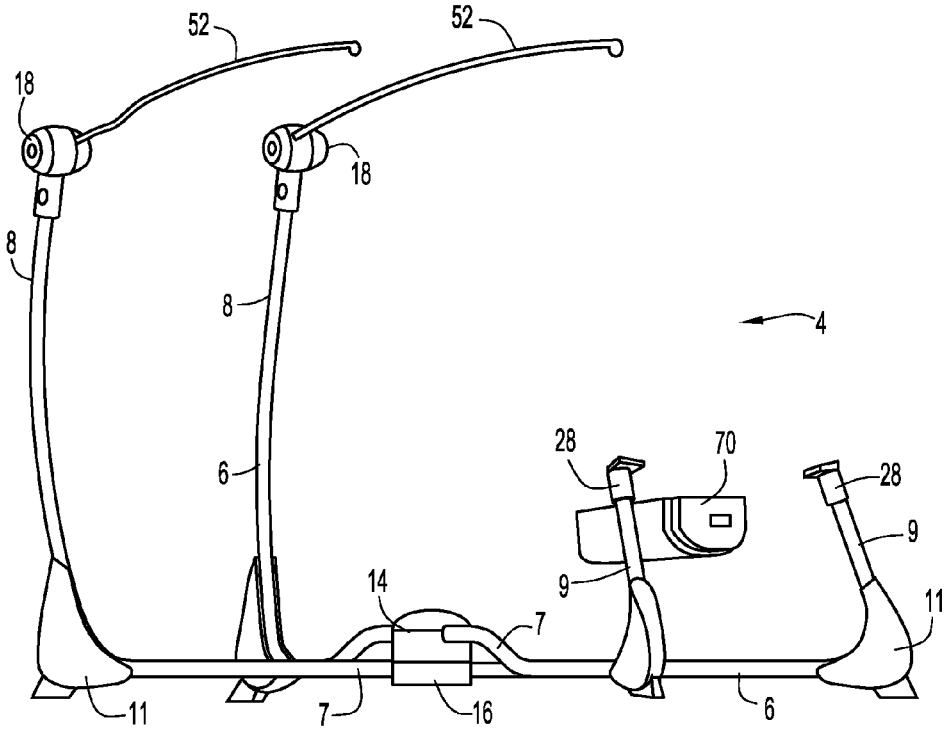
FIG. 4 illustrates a side view of the frame of the infant seat of FIG. 1 in an expanded configuration.
Figure 5:
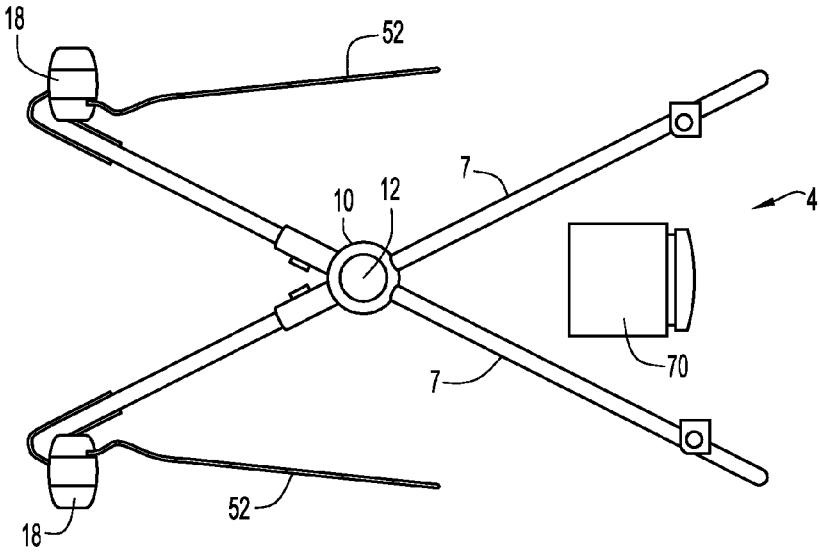
FIG. 5 illustrates a top view of the frame of the infant seat of FIG. 4.
Figure 6:
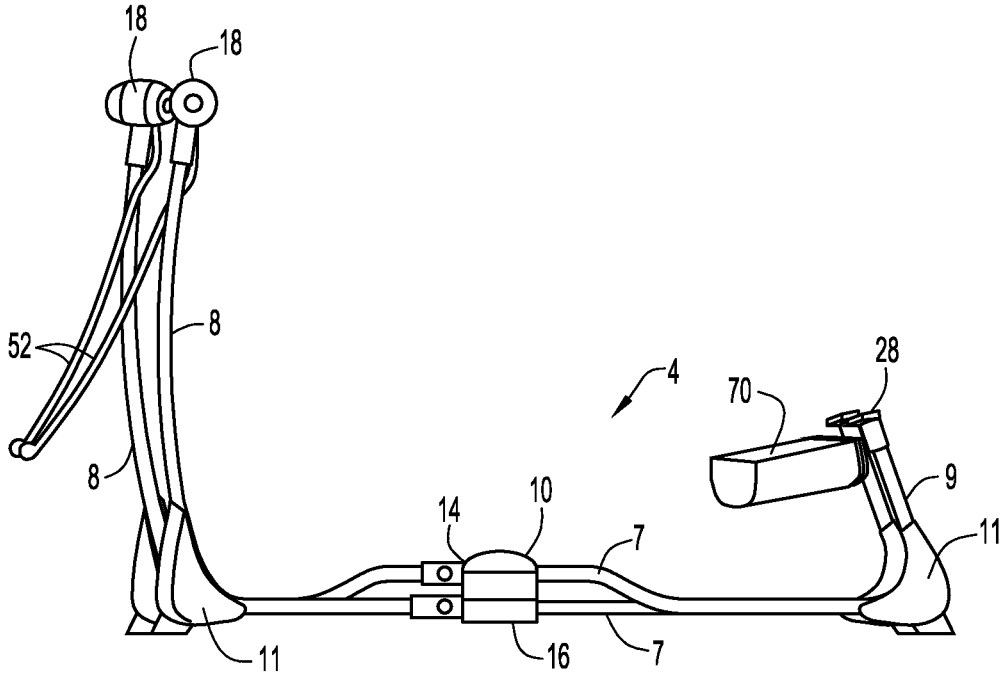
FIG. 6 illustrates a side view of the frame of the infant seat of FIG. 1 in a collapsed configuration.
Figure 7:
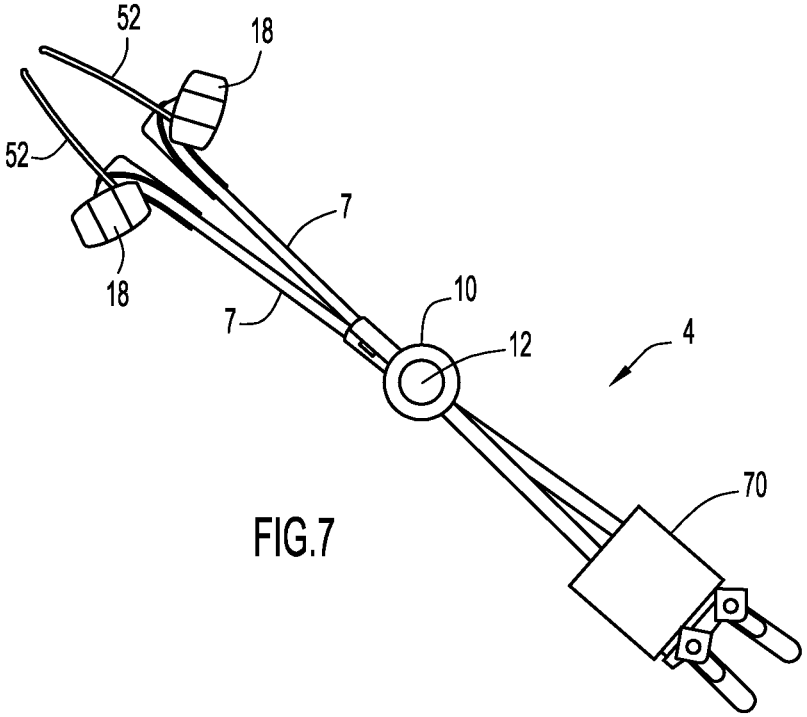
FIG. 7 illustrates a top view of the frame of the infant seat of FIG. 6.

The U-shaped support members 6 are connected with each other at a generally central location along their base portions 7 via a hub connector 10. The hub connector 10 can have any suitable configuration (e.g., a generally rounded or circular configuration as shown in the figures) and includes suitable locking structure that facilitates locking of the U-shaped support members 6 in different spatial configurations with respect to each other. In the example embodiments depicted in the drawings, the hub connector 10 comprises a rotary hub locking structure that locks the U-shaped support members 6 in two configurations with respect to each other as shown in FIGS. 3-7. A release button 12 is provided for the hub connector 10 that is pressed by a user to release the locking engagement of the U-shaped support members 6 with respect to each other by the hub connector 10 so as to allow the members 6 to be moved between a first, extended position that facilitates use of the infant seat 2 and a second, folded or collapsed position (e.g., for facilitating transport or storage of the infant seat 2). The first, extended position of the frame 4 is shown in FIGS. 3-5, where the ends of the two U-shaped support members 6 (i.e., the rear arms 8 and the front arms 9) are extended the furthest distance from each other so as to form a generally X-shaped configuration by the base members 7 (as can be seen in FIG. 5) such that the foot print or area encompassed by the frame 2 is at its greatest extent. The second, folded position of the frame 4 is shown in FIGS. 6 and 7, in which the U-shaped support members 6 are aligned in a generally parallel configuration with respect to each other with the ends of the members 6 being in close proximity to each other such that the foot print or area encompassed by the frame 4 is substantially minimized (thus facilitating easy storage and transport of the infant seat 2).

As can be seen in FIGS. 4 and 6, the hub connector 10 includes two hub portions 14 and 16 that are in a vertically stacked alignment with each other. The hub portions 14, 16 rotate with respect to each other during release of the locking engagement by the release button 12. The base portion 7 of one U-shaped support member 6 is connected to one hub portion 14, while the base portion 7 of the other U-shaped support member 6 is connected to the other hub portion 16. This connection of the U-shaped support members 6 with the two hub portions 14, 16 facilitate the locking of the U-shaped support members 6 with respect to each other in the two configurations. Optionally, the hub connector 10 can also include a spring mechanism that biases the U-shaped support members 6 toward either the outward, first locked position between the members 6 (as shown in FIGS. 4 and 5) or, alternatively, toward the folded, second locked position between the members 6 (as shown in FIGS. 6 and 7) when the release button 12 is pressed to release the locking engagement and allow movement of the members 6 with respect to each other.

Each U-shaped support member 6 includes an elongated support bar 20 that connects at one end via an elastic spring connector 23 to a post 18 located at the upper end of each rear arm 8. Each support bar 20 has a suitable dimension and includes a webbing strap 22 at its other end that extends from the end of the support bar 20 and that is further configured to connect with an upper end of the front arm 9 of the other U-shaped support member 6. In other words, each support bar 20 connects between a rear arm 8 of one U-shaped support member 6 and the front arm 9 of the other U-shaped support member 6. As can best be seen from FIG. 3, when the U-shaped support members 6 are in their outward, first locked position (where the seat 2 is ready for deployment), the support bars 20 extend in a generally parallel manner and at a spaced distance with respect to each other. The support bars 20 can further maintain their connection with the U-shaped support members 6 when the members 6 are folded into their second locked position (as shown in FIGS. 6 and 7), where the support bars 20 will still be maintained generally parallel with each other but in close proximity to each other in the second locked position.

Figure 8:
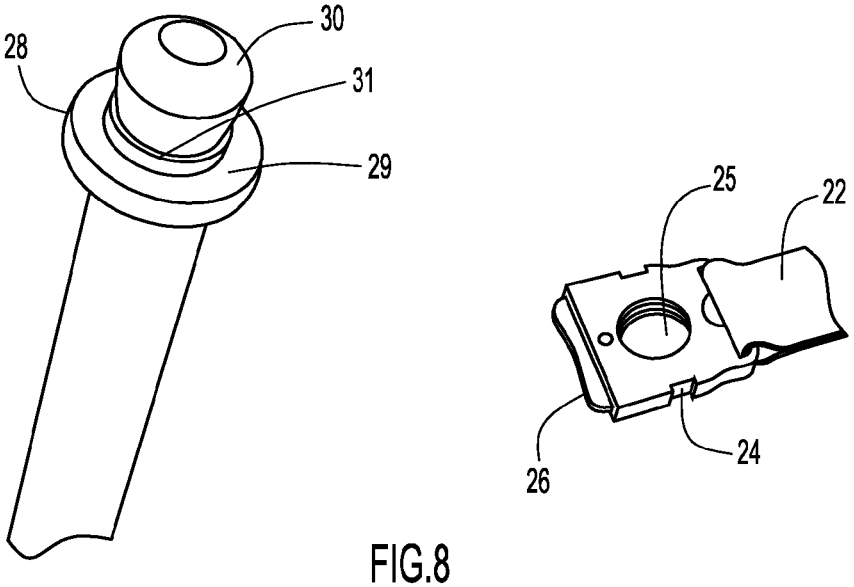
FIGS. 8 and 9 illustrate views showing the connection of a flexible strap portion of a support bar to a portion of a U-shaped frame member of the infant seat of FIG. 1.
Figure 9:
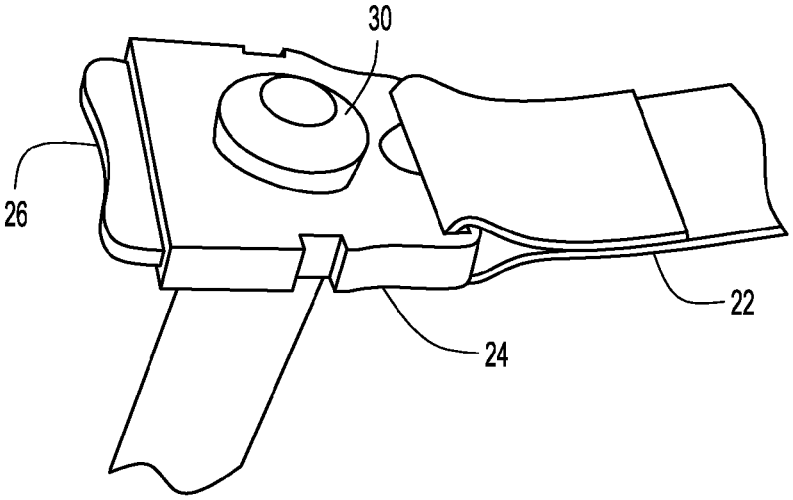

Each support bar 20 can optionally be releasably secured at one or both ends to one or both of the U-shaped members 6. For example, referring to FIGS. 8 and 9, the strap 22 of each support bar 20 can include a buckle 24 disposed at its free end, where each buckle includes a generally circular opening 25 and the opening 25 is configured to engage with and fasten the strap 22 to a receiving member 28 disposed at the free end of the front arm 9 for the corresponding U-shaped member 6 to which the support bar 20 connects. Each receiving member 28 includes a support ledge 29 and a generally cylindrical protrusion 30 extending from the support ledge 29, where the cylindrical protrusion further includes an annular groove 31 extending around the protrusion 30. The opening 25 of each buckle 24 is suitably dimensioned to facilitate fitting the buckle 24 around the protrusion 30 while resting upon the support ledge 29. Each buckle 24 further includes one or more locking members that are spring biased and extend radially inward within the opening 25 to as to engage within the annular groove 31 to lock the buckle 24 with the receiving member 28 when the buckle is fit around the protrusion 30. A release button 26 is provided on each buckle 24 that can be depressed to at least partially disengage the locking members of the buckle 24 from within the annular groove 31 so as to release the buckle 24 from its locking engagement with the receiving member 28. Alternatively, it is noted that the strap 22 for each support bar 20 can connect in any other suitable manner with the receiving member 28 (e.g., via a removable or non-removable connection) to effectively secure the bar 20 and strap 22 between corresponding upper ends of each U-shaped support member 6.

The combination of the spring connection (via spring connectors 23) between the post 18 at the upper end of the rear arm 8 of each U-shaped support member 6 and the one end of the support bar 20 and the flexible strap 22 to connect (e.g., via its buckle 24), with the receiving member 28 at the upper end of the front arm 9 of each member 6 facilitates a sufficient bridging structural connection for the frame 4 between the front and rear ends of each U-shaped support member 6 (as shown in FIG. 3). The bridging connection provides sufficient structural support for attaching the flexible seat portion 40 to the frame 4 (as shown in FIGS. 1, 2 and 10-14). In addition, the spring connection at the posts 18 and the ends of the support bars 20 can be designed to provide an elastic or bouncy effect for the seat portion 40 when an infant or child is seated on the seat 2.

In particular, as can be seen in the figures, the flexible seat portion 40 comprises a suitable flexible soft goods material (e.g., a fabric material), where peripheral edge portions of the seat portion 40 are secured to portions of the support bars 20 and/or upper front and rear end portions of each U-shaped support member 6. The seat portion 40 can be secured via its peripheral edge portions in any suitable manner to the frame 4. For example, the peripheral edge portions of the seat portion 40 can include any suitable fastening mechanism (e.g., snap connectors, looping tie fasteners, etc.) that provide a secure connection between the seat portion 40 and the support bars 20 and/or upper ends of the U-shaped support members 6 that is sufficient to support the weight of an infant or child supported by the seat 2 while maintaining the connection between the seat portion 40 and the frame 4. In the example embodiments depicted in the figures, and with specific reference to FIG. 2, the support bars 20 can include locking protrusions 42 that extend transversely from the bars 20 and extend through openings disposed at peripheral edge portions of the seat portion 40 to provide a secure connection between the seat portion 40 and the frame 4 that effectively supports the weight of an infant or child while allowing for easy removal of the seat portion (e.g., to facilitate cleaning of the seat portion 40).

In addition to the flexible seat portion 40, another flexible, soft goods material can also be provided and directly connected with the support bars 20 so as to serve as an underlying layer for the flexible seat portion 40. In this embodiment, the two soft goods materials (from the flexible seat portion 40 and from the underlying layer) provide a double or dual flexible layer for the folding seat. This can be useful, e.g., for providing additional structural support for a child seated on the seat portion 40 as well as providing an easy mechanism for removal of the upper layer or flexible seat portion 40 from the underlying portion (which connects directly with the support bars 20) to facilitate cleaning of the seat portion 40 during periods of non-use.

As also best seen in FIG. 2, due to the difference in lengths between the rear arms 8 and front arms 9 of the U-shaped support members 6, the support bars 20 and flexible straps 22 extend at a decline between the rear arms 8 and the front arms 9 of the frame 4. Thus, when the seat portion 40 is secured to the support frame 4, the seat portion 40 provides a reclined, relaxing position for an infant or child that is supported by the seat portion 40.

Figure 10:
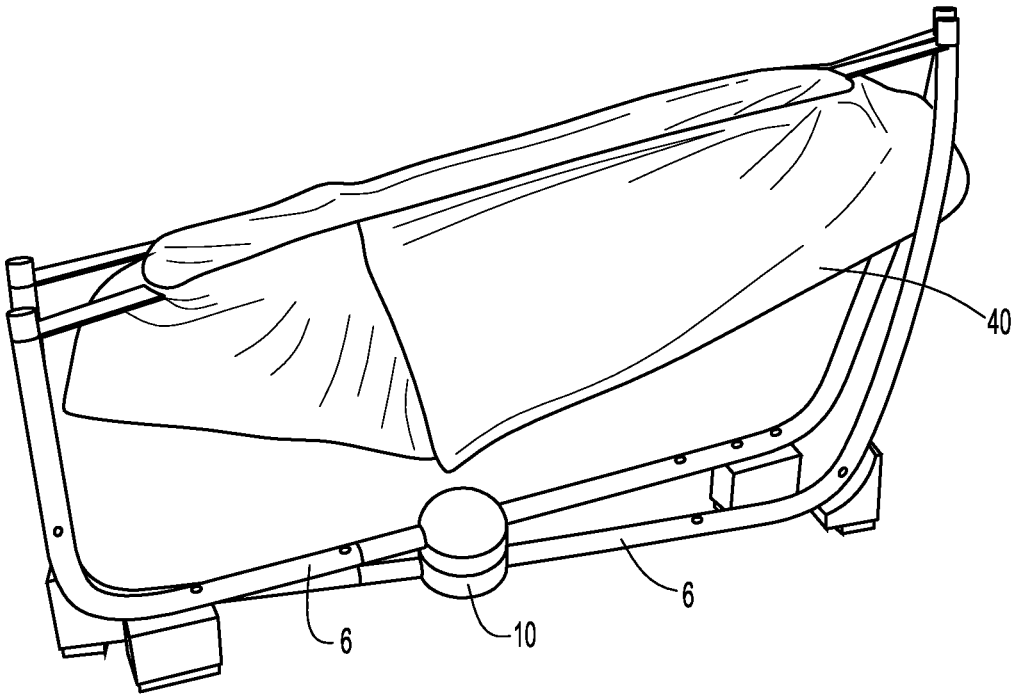
FIG. 10 illustrates a view of an infant seat with the frame and seat support in a folded configuration in accordance with an example embodiment of the present invention.

The flexible material of the seat portion 40 also facilitates easy folding of the frame 4 into the second position with the seat portion 40 folding inwardly so as to be generally disposed between the support bars 20 and the U-shaped support members 6. This configuration is depicted in the embodiment of FIG. 10. The folding of the seat portion 40 in this manner further forms a pocket between peripheral edge portions of the seat portion 40, and this pocket can be used, e.g., to store items (e.g., toys or other accessories associated with the seat 2).

The seat portion 40 can optionally include any suitable restraining elements 41 (e.g., straps that connect with a buckle or other fastening mechanism) that are configured to restrain an infant or child within the seat portion 40 during use of the seat 2.

Figure 11:
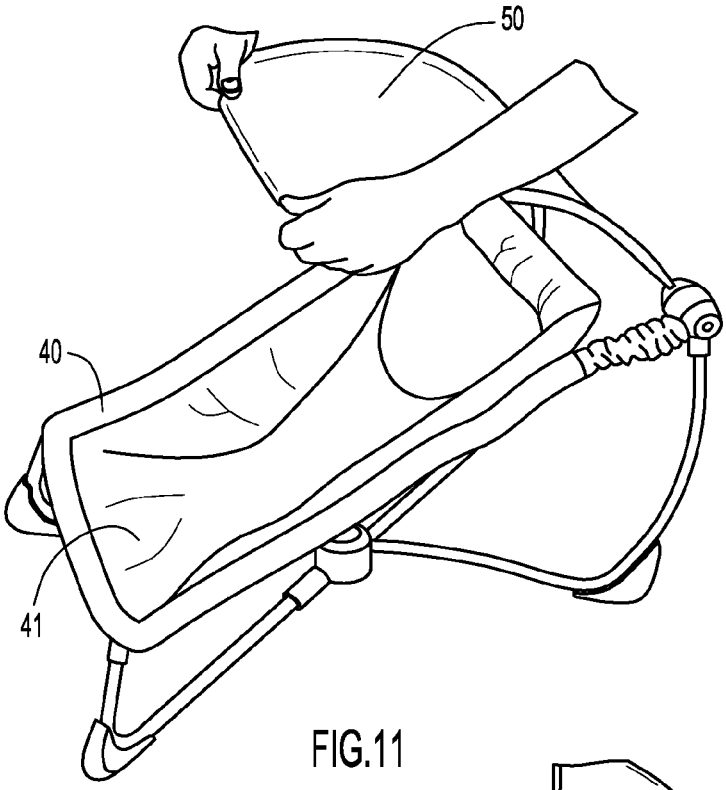
FIGS. 11-13 illustrate different orientations of the canopy of the infant seat of FIG. 1.
Figure 12:
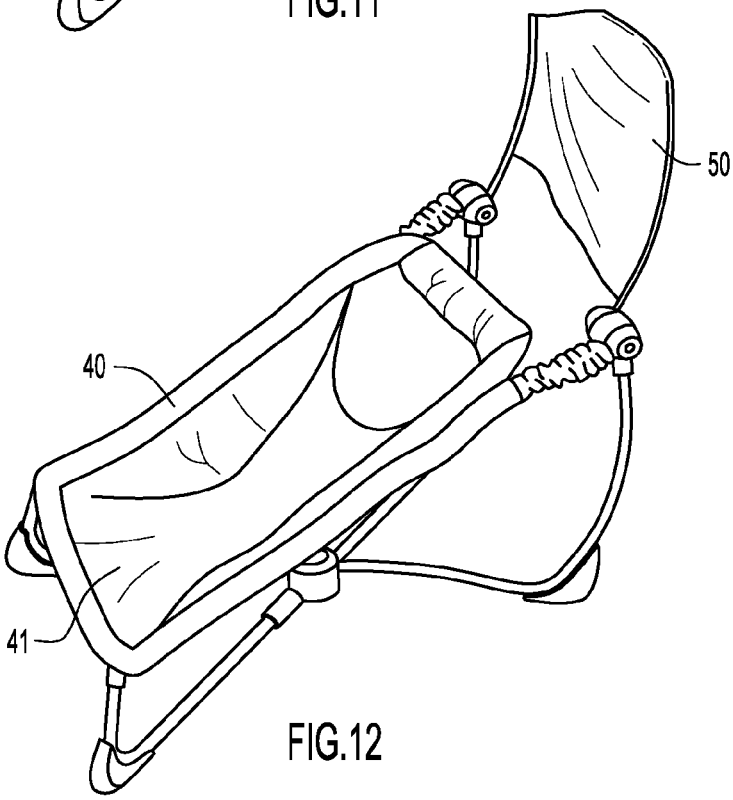
Figure 13:
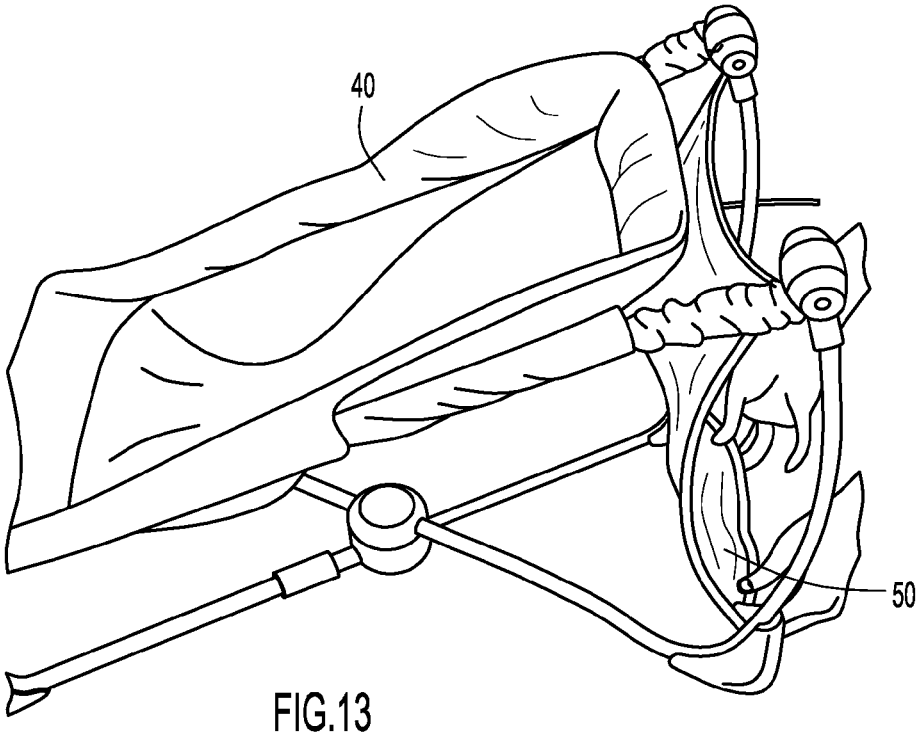

As shown in FIGS. 4-7, the canopy 50 includes a pair of elongated supporting frame members 52, each frame member 52 being pivotally connected with the post 8 of a corresponding rear arm 18 of a U-shaped frame member 6. A flexible soft goods material canopy member 50 (e.g., a cloth or fabric material) is supported by the frame members 52. For example, the canopy member 50 can include a stitched pocket at opposing peripheral ends of the canopy member 50, where a frame member 52 is inserted within a corresponding stitched pocket to provide support for the canopy member 50 and to also move it into different positions with respect to the seat member 40 and frame 4 by pivotal movement of the frame members 52. In particular, the canopy 50 can be rotated from a deployed position as shown in FIG. 11 (where the canopy member 50 is disposed over or overlies the seat member 40) to various retracted positions as shown in FIGS. 12 and 13. In the retracted position of the canopy 50 as shown in FIG. 13, the supporting frame members 52 and canopy member 50 have been rotated to a storage position that is offset approximately 270° from the deployed position shown in FIG. 11. Thus, when the U-shaped support members 6 are folded into the second position as shown in FIGS. 6 and 7, and the canopy 50 is in its retracted position (such as the position shown in FIG. 13), the canopy 50 (similar to the seat portion 40) folds inwardly such that the seat 2 including the canopy 50 can be easily stored and transported.

Any number of toys and/or other accessories can be provided with the seat 2 and can be connected at any one or more suitable locations on portions of the seat 2. In the example embodiments, the canopy 50 includes supporting structure that supports suspended toys 60. For example, toys 60 can be suspended via a flexible cord or strap that attaches to a portion of a frame member 52 or the canopy member 50.

Figure 14:
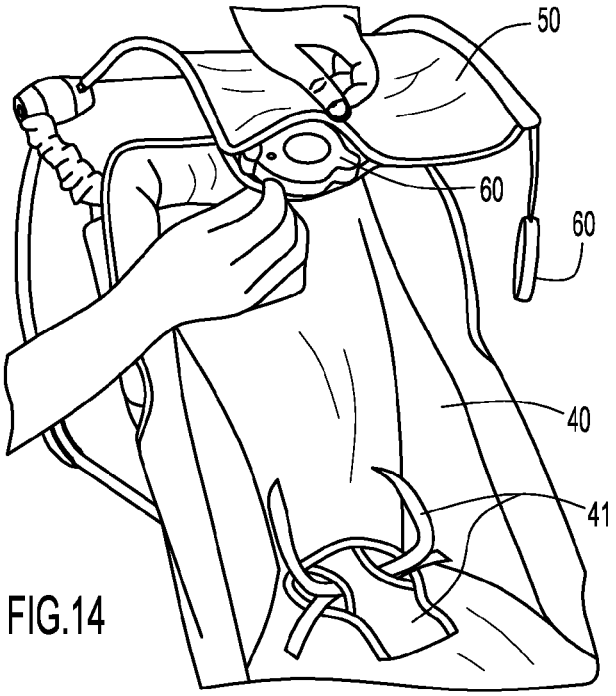
FIG. 14 illustrates a storage pocket for the canopy of the infant seat of FIG. 1.

The canopy member 50 also includes one or more pockets formed between layers of the member 50 (e.g., between two fabric layers). Toys (such as the canopy's hanging toys 60) and/or other items can be stored within the one or more pockets. An example of a pocket for the canopy member 50 is depicted in FIG. 14. In particular, FIG. 14 depicts a toy 60 is being inserted within a pocket of the canopy member 50 for storage. Each pocket of the canopy member 54 can include a suitable closure structure, such as cooperating hook-and-loop fasteners, button fasteners, zipper fasteners, etc. formed between the layers of the pocket to selectively open and close the pocket.

As shown in the figures, the infant seat 2 can optionally include an electronic unit 70 that provides vibratory motions and/or sounds that can be selectively controlled by a user during operation of the infant seat 2. The electronic unit 70 can include a switch 72 (see FIG. 1) that allows the user to adjust control of the electronic unit 70 to a variety of different settings which provide different sounds and/or different vibratory motions for the seat 2.

Operation of the infant seat 2 is now described with reference to the figures. In a scenario in which the infant seat 2 is in a folded (e.g., stored) configuration (as shown in FIGS. 6, 7 and 10), a user presses the locking button 12 of the hub connector 10 to release the locking engagement between the two U-shaped support members 6. The U-shaped support members 6 are then expanded, with hub portions 14 and 16 rotating with respect to each other, until they lock in the expanded X-shape configuration for the base portions 7 as depicted in FIGS. 1-5. In embodiments in which the support bars 20 are removably or releasably securable to portions of the frame and the seat member 40 is not secured to the frame, the strap 22 of each support bar 20 can be stretched such that its buckle 24 fits over and locks with the protrusion 30 of the receiving member 28 disposed at the upper end of a corresponding front arm 9. In embodiments in which the straps 22 of the support bars 20 are already (e.g., non-removably) secured to the receiving members 28, no manual connection between support bars, straps and any portions of the U-shaped support members 6 is necessary. When both support bars 20 are connected so as to form a bridging support structure between the front and rear ends of the support frame 4, the seat member 40 can be secured to the frame 4 (e.g., by securing the peripheral edge portions of the seat member 40 to portions of the support bars 20). Alternatively, in a scenario in which both the support bars 20 and the seat member 40 are already secured to the frame 4 in the folded (e.g., storage) position (e.g., in a configuration such as is shown in FIG. 10), the expansion of the U-shaped support members to the X-shape configuration for the base portions 7 results in an unfolding of the seat member 40 to a deployment configuration such as is shown in FIGS. 1 and 2. Thus, a user presses the lock button 12 to unlock the hub portions 14, 16 with respect to one another and the spring connections 23 pull the seat 2 from the collapsed position to the open, use position. An infant or child can be placed so as to be supported by and seated on the seat member 40, while also securing the restraining elements 41, e.g., around the waist and legs of the infant to prevent the infant from inadvertently falling from the seat 2.

The canopy 50, which may be oriented in a storage position (as depicted in FIG. 13) can be rotated upward, by pivoting the canopy frame members 52 with respect to the U-shaped support member posts 18, until the canopy 50 is in an orientation such that it is suspended over a portion of the seat member 40 (as depicted in FIGS. 11 and 14). Any toys or other items (e.g., toys 60) that may be stored within one or more pockets of the canopy member 50 can be removed and assembled in any suitable manner with portions of the seat 2. In addition, the electronic unit 70 can be selectively activated by a user to provide motion and/or musical entertainment to the infant supported by the seat 2.

After use (and after removal of the infant or child from the seat 2), the canopy 50 can be rotated back to its storage position (as shown in FIG. 13) and the frame 4 can be folded or collapsed to a storage position by pressing the locking button 12 of the hub connector 10 and rotating the ends of the U-shaped support members 6 toward each other to the locked position as shown in FIGS. 6, 7 and 10. In addition, toys or other items can be placed within the canopy pockets for storage, and the seat member 40 can optionally be removed from the frame 4 and the ends of the support bars 20 optionally separated from the upper ends of the front arms 9. Alternatively, as previously noted, the seat 2 can be folded into its storage position without removing the seat member 40 and/or disengaging the ends of the support bars 20 from the upper ends of the front arms 9 of the frame 4 (e.g., as shown in FIG. 10). In the storage configuration (FIG. 10), the seat member 40 is folded between the U-shaped support members 6 and provides a further pocket for storage of items (e.g., for toys and/or other accessories associated with the seat 2). The canopy member 50 is also folded in its storage position so as to be disposed between the U-shaped support members 6 (e.g., between the rear arms 8 of the U-shaped support members 6).

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

What is claimed is:

1. A foldable infant seat comprising:

a support frame comprising two generally U-shaped support members, each U-shaped support member pivotally connecting with the other at a central location of the U-shaped support member such that the support frame is foldable between a first configuration in which corresponding ends of the U-shaped support members are separated from each other and a second configuration in which the corresponding ends of the U-shaped support members are disposed in close proximity to each other;

a flexible seat member securable to the support frame;

a canopy pivotally secured to the support frame, the canopy including at least one pocket configured to store one or more items, wherein each U-shaped support member includes a base portion that supports the U-shaped support member on a support surface, a front arm and a rear arm extending from opposing ends of the base portion in an upward direction away from the support surface when the base portion is supported on the support surface, and the U-shaped support members are pivotally connected at their base portions;

a pair of support bars, each support bar connecting with the front arm of one of the U-shaped support members and the rear arm of the other of the U-shaped support members; and wherein the flexible seat member is securable to the support bars.

2. The foldable infant seat of claim 1, wherein the canopy is rotatable in relation to the support frame from a deployed position that overlies the flexible seat member when the support frame is in the first configuration to a retracted position when the support frame is in the second configuration.

3. The foldable infant seat of claim 1, wherein the flexible seat member is bendable to be folded between the U-shaped support members when the support frame is folded into the second configuration.

4. The foldable infant seat of claim 1, wherein the support bars extend at a decline from the rear arms to the front arms of the U-shaped support members.

5. The foldable infant seat of claim 1, wherein at least one of the support bars is releasably secured to at least one of the U-shaped support members.

6. The foldable infant seat of claim 1, further comprising:

a hub connector that pivotally connects the U-shaped support members and releasably locks the U-shaped support members in the first and second configurations.

7. The foldable infant seat of claim 1, further comprising:

an electronic unit that is operatively coupled to the support frame and is controllable to provide at least one of vibratory motions for the flexible seat member and sounds during operation of the foldable infant seat.

8. A foldable infant seat comprising:

a support frame comprising two generally U-shaped support members, each U-shaped support member including a base portion that supports the U-shaped support member on a support surface, a front arm and a rear arm extending from opposing ends of the base portion in an upward direction away from the support surface when the base portion is supported on the support surface, wherein each base portion is pivotally connected to the other base portion such that the support frame is foldable between a first configuration in which the front arms of each of the U-shaped support members are separated from each other and the rear arms of each of the U-shaped support members are separated from each other and a second configuration in which the front arms of each of the U-shaped support members are in close proximity to each other and the rear arms of each of the U-shaped support members are in close proximity to each other;

a pair of support bars, each support bar connecting with the front arm of one of the U-shaped support members and the rear arm of the other of the U-shaped support members; and a flexible seat member securable to the support bars.

9. The foldable infant seat of claim 8, wherein the flexible seat member is bendable to be folded between the U-shaped support members when the support frame is folded into the second configuration.

10. The foldable infant seat of claim 8, wherein the support bars extend at a decline from the rear arms to the front arms of the U-shaped support members.

11. The foldable infant seat of claim 8, wherein at least one of the support bars is releasably secured to at least one of the U-shaped support members.

12. The foldable infant seat of claim 8, further comprising:

a hub connector that pivotally connects the base portions of the U-shaped support members and releasably locks the U-shaped support members in the first and second configurations.

13. The foldable infant seat of claim 8, further comprising:

an electronic unit that is operatively coupled to the support frame and is controllable to provide at least one of vibratory motions for the flexible seat member and sounds during operation of the foldable infant seat.

14. The foldable infant seat of claim 8, further comprising:

a canopy pivotally secured to the support frame.

15. A method of using a foldable infant seat, the infant seat comprising a support frame including two generally U-shaped support members, each U-shaped support member including a base portion, a front arm and a rear arm extending from opposing ends of the base portion, wherein each base portion is pivotally connected to the other base portion, a pair of support bars, each support bar connecting with the front arm of one of the U-shaped support members and the rear arm of the other of the U-shaped support members, and a flexible seat member securable to the support bars, the method comprising:

unfolding the support frame from a storage configuration in which the front arms of each of the U-shaped support members are in close proximity to each other and the rear arms of each of the U-shaped support members are in close proximity to each other to an open configuration in which the front arms of each of the U-shaped support members are separated from each other and the rear arms of each of the U-shaped support members are separated from each other.

16. The method of claim 15, wherein the flexible seat member is folded between the U-shaped support members when the support frame is in the storage configuration and, in response to unfolding of the support frame, the flexible seat member is unfolded to facilitate use of the seat member.

17. The method of claim 15, wherein the foldable infant seat further includes a canopy that is pivotally secured to the support frame, and the method further comprises:

rotating the canopy in relation to the support frame from a retracted position to a deployed position such that the canopy overlies the seat member when the support frame is unfolded to the open configuration.

18. The method of claim 17, further comprising:

removing one or more items from a pocket within the canopy.

19. The method of claim 17, further comprising a hub connector that pivotally connects the base portions of the U-shaped support members and releasably locks the U-shaped support members in the open and storage configurations, wherein the unfolding comprises unlocking the hub connector to unfold the U-shaped support members, and the method further comprises:

folding the U-shaped members together so as to be locked in the storage configuration by the hub connector.

* * * * *